US005720471A

United States Patent [19]

Constantinescu et al.

[11] Patent Number: 5,720,471

[45] Date of Patent: Feb. 24, 1998

[54] LOW PROFILE COMPOSITE MATERIAL BEDDING FOUNDATION SYSTEM AND METHODS OF MANUFACTURE

[75] Inventors: Eugen Constantinescu, Westlake; Mark J. Quintile, Brunswick; Robert F. Wagner, Medina, all of Ohio

[73] Assignee: The Ohio Mattress Company Licensing & Components Group, Cleveland, Ohio

[21] Appl. No.: 487,022

[22] Filed: Jun. 7, 1995

[51] Int. Cl.[6] ..... F16F 3/10; A47C 23/04

[52] U.S. Cl. ..... 267/81; 5/247; 5/255; 267/110; 267/143

[58] Field of Search ..... 5/255, 247, 476; 267/81, 95, 96, 103, 106, 107, 109, 110, 111, 143, 151

[56] References Cited

U.S. PATENT DOCUMENTS

| | | | |
|---|---|---|---|
| 488,378 | 12/1892 | Bell | 5/247 |
| 2,115,400 | 4/1938 | Schlappritzi et al. | 5/247 |
| 2,239,062 | 4/1941 | Tallmadge . | |
| 2,242,731 | 5/1941 | Tallmadge | 5/247 |
| 2,503,333 | 4/1950 | Gyles | 5/255 |
| 3,633,228 | 1/1972 | Zysman | 267/143 X |
| 4,245,362 | 1/1981 | Mueller | 267/95 X |
| 4,251,892 | 2/1981 | Hancock | 5/255 |
| 4,411,159 | 10/1983 | Spear et al. . | |
| 4,519,591 | 5/1985 | Bush et al. . | |
| 4,530,490 | 7/1985 | Misumi et al. . | |
| 4,675,927 | 6/1987 | Mizelle . | |
| 4,736,932 | 4/1988 | Haslim | 267/42 X |
| 4,776,572 | 10/1988 | Surletta et al. . | |
| 4,964,624 | 10/1990 | Ciolczyk et al. | 267/81 |
| 5,142,715 | 9/1992 | Ogle et al. | 5/247 |
| 5,165,125 | 11/1992 | Callaway . | |
| 5,265,291 | 11/1993 | Callaway . | |
| 5,426,799 | 6/1995 | Ottiger et al. | 267/151 X |

FOREIGN PATENT DOCUMENTS

| | | | |
|---|---|---|---|
| 323224 | 12/1929 | United Kingdom | 5/247 |

*Primary Examiner*—Josie Ballato
*Attorney, Agent, or Firm*—Calfee Halter & Griswold

[57] ABSTRACT

A low profile composite material bedding foundation system and methods of manufacture and assembly uses spring modules made of molded composite materials and supported by inner frame members. The low-profile of the spring modules, and the composite material spring property of return to uncompressed state from total depth deflection without set, greatly decreases the height of the bedding foundation in which the spring modules are attached directly to foundation frame members. The small size and simple geometry of the spring modules is especially suited for flexible arrangement and automated assembly of low-profile foundations.

28 Claims, 12 Drawing Sheets

LOW PROFILE COMPOSITE MATERIAL BEDDING FOUNDATION SYSTEM AND METHODS OF MANUFACTURE

FIELD OF THE INVENTION

The present invention pertains generally to bedding foundations and, in particular, to the internal weight bearing structures of bedding foundations.

BACKGROUND OF THE INVENTION

Conventional bedding systems in the United States include a mattress supported by a foundation or "box spring". Foundations are provided to give support and firmness to the mattress as well as resilience in order to deflect under excessive or shock load. Foundations are typically composed of a rectangular wooden frame, a steel wire grid spaced above the wooden frame and supported by a number of steel wire coils such as compression type springs which are secured to the wooden frame. In order to properly support and maintain the firmness level in the mattress, a large number of compression springs are needed in the foundation, resulting in high production cost. This is the main disadvantage of using compression springs in mattress foundation. Also, foundations which use compression springs typically have a low carbon wire grid or matrix attached to the tops of the springs. Both the wires and the welds of the matrix can be broken under abusive conditions.

In an effort to avoid the high cost of using compression springs in foundations, another type of spring used is the torsional steel spring formed from steel spring wire bent into multiple continuous sections which deflect by torsion when compressed. Because torsional sprigs are dimensionally larger and stiffer than compression springs, fewer torsional sprigs are needed in the foundation. However, the manufacture of torsional-type springs from steel wire requires very expensive tooling and bending equipment. Elaborate progressive bending dies are required to produce the complex torsional spring module shapes which may include four or more adjoining section. The manufacturing process is not economically adaptable to produce different spring configurations without new tooling, tooling reworking and/or machinery set-up changes and process disruption, etc. Therefore, the configuration and resultant spring rate of such springs cannot be easily or inexpensively altered to produce foundations with different support characteristics. Furthermore, the many bends in these types of springs make dimensional quality control and spring rate tolerance control very difficult to achieve. Also, variations in steel material properties and the need for corrosion protection and heat-treating add to the cost and difficulty of producing steel wire spring modules. And furthermore, the awkward geometry of the relatively large torsional springs makes assembly of the springs in the foundation frame difficult.

Another disadvantage of the use of steel wire springs in foundations, and a particular disadvantage of torsional springs, is the phenomenon of "spring set" in which a spring does not return completely to an uncompressed height following excessive loading. So long as a spring is deflected within its spring rate tolerance range, it can be repeatedly loaded for a certain number of cycles without noticeable change in operating characteristics. However, if deflected past the maximum deflection range, it will undergo permanent deformation or "set", resulting in a change in operating characteristics such as lack of reflexive support, permanent change in shape, or catastrophic failure in the form of breakage. Spring set in steel wire springs may also occur simply following prolonged normal use, i.e., wear and tear.

A growing problem in the bedding industry is the trend toward mattresses of greater thickness dimension which, when placed on top of traditional foundations of six to eight inch height, are too high in proportion to the head and foot boards of beds, resulting in an awkward appearance. This trend toward larger mattress and foundations is increasing distribution and storage costs.

Bedding foundations in the United States typically measure on the order of five to eight inches thick, with an average thickness (or height) of six and one half to seven and one half inches. In conventional foundations, most all of this dimension is attributable to the height of the spring modules. In general, deflection of torsional spring modules is limited to approximately 20% of the total height dimension. Compression which exceeds the 20% range can cause spring set or breakage. Reducing the overall height of torsional spring modules can make the spring too rigid or diminishes its deflection and support capabilities. Moreover, the number of cycles to failure during life testing is generally harder to predict with shortened height spring wire modules and is usually many less cycles to failure than spring wire modules of greater height.

Accordingly, there is a need for an entirely new foundation design and construction concept which avoids and overcomes the many deficiencies of the prior art including spring set, production quality control and expense, excessive height dimension and other problems.

SUMMARY OF THE INVENTION

The present invention is a new low profile/low height abuse resistant and long life bedding foundation which employs low-profile springs modules formed of composite materials. The total height of the composite material bedding foundation is approximately one-half the height of traditional foundations, yet has improved deflection/resilience characteristics over traditional foundations. The composite material spring modules are used in place of traditional wire springs as the principle reflexive support components.

The invention further includes a novel method of manufacturing foundation spring modules from composite materials such as epoxy and fiberglass combinations, by molding such materials in various spring shapes particularly adapted and especially suited for use as support elements in a bedding foundation. The invention still further includes a novel method of selective assembly of foundation units using composite material spring modules wherein the spring modules are selectively arranged upon and attached to a frame structure and to an overlying grid.

In a preferred embodiment of the spring modules, composite material is molded into a generally C-shape spring module to provide a low depth/height dimension and efficient stress and load distribution capability. The use of molded composite material spring modules, and in particular the C-shape composite material spring module, provides numerous manufacturing and assembly advantages over prior art wire springs, including simplified part handling and ready adaptability to automated assembly processes for both subassembly and final assembly of foundation units. Furthermore, the novel method of molding foundation spring modules from composite materials is readily adaptable to the manufacture of a wide variation of spring modules having different shapes and support and deflection characteristics such as spring rate, without substantial retooling.

In accordance with one aspect of the invention, a low profile composite material bedding foundation includes low profile spring modules formed from composite material molded to have suitable spring rates and improved spring rate tolerances, and are configured for attachment to spring module supporting frame members and to an overlying wire grid to form a reflexive support structure for a mattress.

In accordance with another aspect of the invention, a composite material bedding foundation system and method of manufacture comprises a frame including inner frame members adapted to support selectively arranged low-profile molded composite material spring modules which have a spring property of return to uncompressed state from total depth deflection without spring set, wherein the composite material spring modules are deflectable through an entire depth dimension of the modules.

In accordance with still another aspect of the invention, a low profile composite material bedding foundation system and method of manufacture includes inner frame members adapted to engage a plurality of molded composite material spring modules, clips for attaching spring ends of the spring modules to a wire grid over the inner frame members.

In accordance with still another aspect of the invention, a low profile composite material bedding foundation system and method of manufacture includes selection of molded composite material spring modules according to spring rates and spring rate tolerances, attachment of a selected number of spring modules to inner frame members of a foundation frame, selective arrangement of a selected number of inner frame members within a foundation frame perimeter, and attachment of a grid to the spring modules.

These and other aspects of the invention are now described in particularized detail with reference to the accompanying Figures.

DETAILED DESCRIPTION OF EMBODIMENTS OF THE INVENTION

Figure 1:
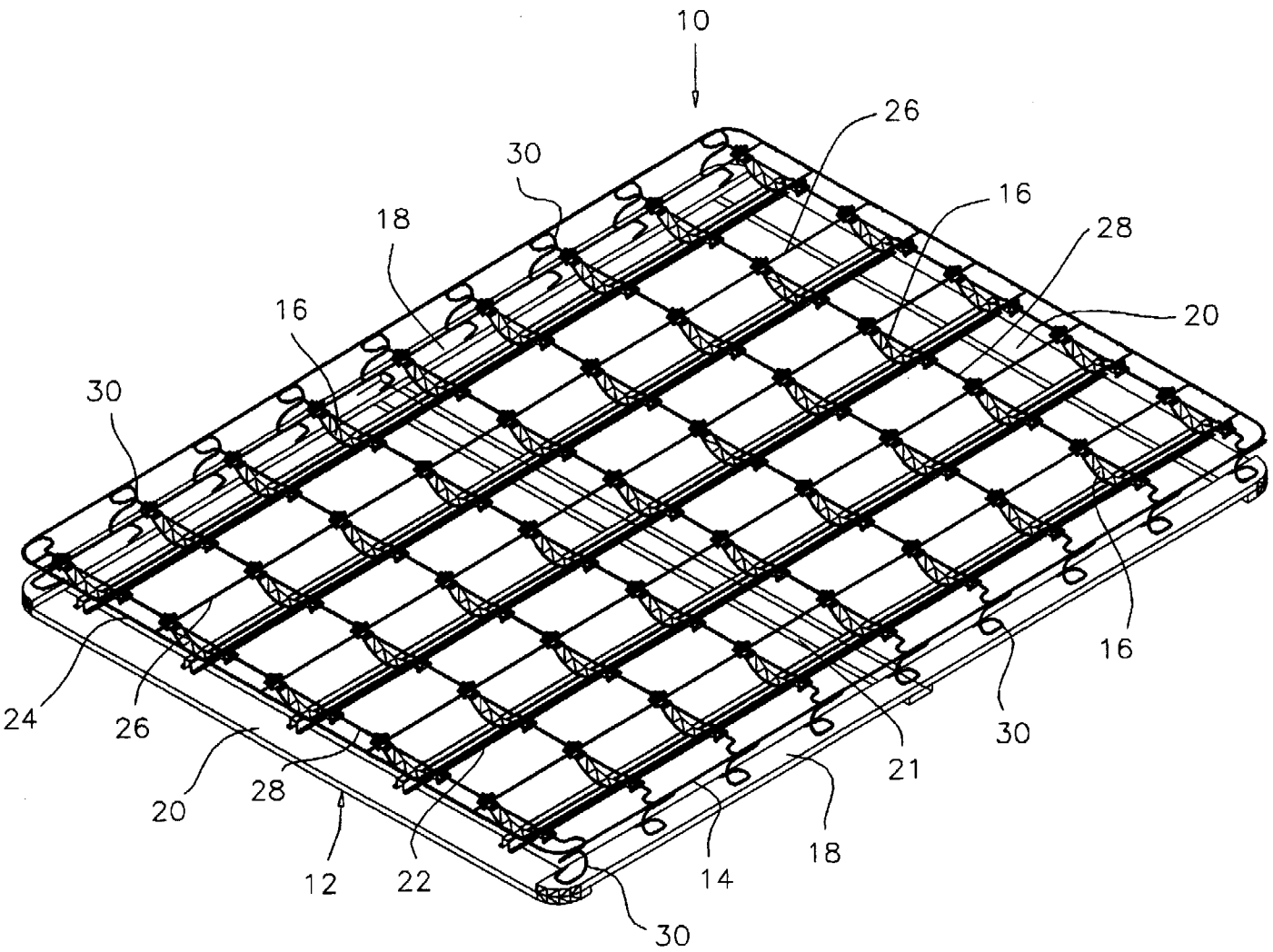
FIG. 1 is an isometric view illustrating an embodiment of a low profile composite material bedding foundation of the present invention.

FIG. 1 illustrates one embodiment of a composite material bedding foundation, indicated generally at 10, constructed in accordance with the invention. The foundation 10 includes a frame, indicated generally at 12, a grid or matrix 14 disposed parallel to and above frame 12 as a mattress supporting surface, and a plurality of molded composite material spring modules 16. In this embodiment, frame 12 includes two longitudinally extending perimeter members 18, two transversely extending perimeter members 20, and a transverse central member 21, all of which may be constructed of wood or steel or other suitable material and secured together to form a rectilinear frame. A plurality of longitudinally extending inner frame members 22 (which may be constructed of wood or steel, or extruded or pultruded plastic such as polyethylene or polypropylene or fiberglass reinforced plastic) attached to transverse perimeter members 20 and central member 21, provide attachment points for the composite material spring module 16 as further described below. Grid 14 may be constructed of low carbon or high carbon steel, but may alternatively be formed of composite material such as pultruded fiberglass reinforced plastic which is then glued or otherwise fastened in the matrix arrangement, or by composite material molding processes suitable for relatively large structures such as rotational molding or injection molding of structural foam.

The grid 14 is formed by a peripheral border element 24, of generally the same width and length dimensions of frame 12, a plurality of longitudinal elements 26, and a plurality of transverse elements 28 which intersect longitudinal elements 26 to define a rectilinear grid which supports a mattress. The terminal ends of transverse elements 28 are downwardly bent to form vertical support elements 30 secured to frame 12 to support peripheral border wire 24 and the grid over frame 12. Support elements 30 may be selectively formed to deflect in the manner of a spring as is known in the art. As further shown in FIG. 1, the matrix portion of grid 14 is further supported over frame 12 by the plurality of spring modules 16 attached at a bottom point to inner frame members 22 and at upper points to intersecting grid elements 26 and 28 of grid 14.

The embodiment of FIG. 1 is shown with a plurality of composite material spring modules molded in a generally C-shape or U-shape configuration (shown in perspective isolation in FIG. 2), attached to inner frame members 22 in a position concave relative to the surface defined by grid 14, and with a length dimension of the modules disposed transverse to the length of foundation 10. The following describes a manner and method of attachment of the C-shape module to frame 12 and grid 14. However, it is to be understood that the principles and innovations of the invention are equally applicable to all of the module configurations and shapes disclosed herein and equivalents, and to all equivalent manners and methods of attachment of modules of any shape to any frame and grid arrangement.

Figure 2:
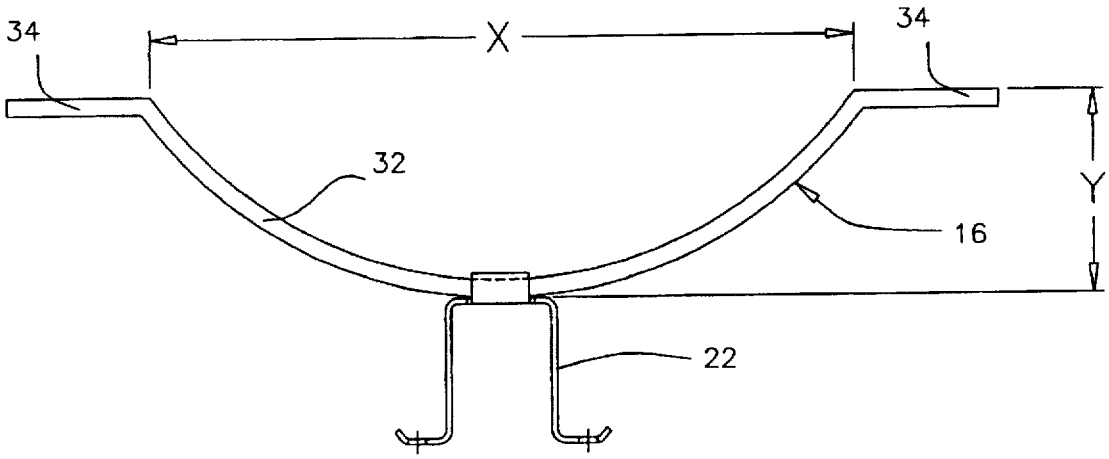
FIG. 2 is an elevational view of a section of the foundation of FIG. 1 showing the profile of the composite material spring module and its arrangement with respect to, and method of attachment to, a frame member of the bedding foundation of the present invention.
Figure 3:
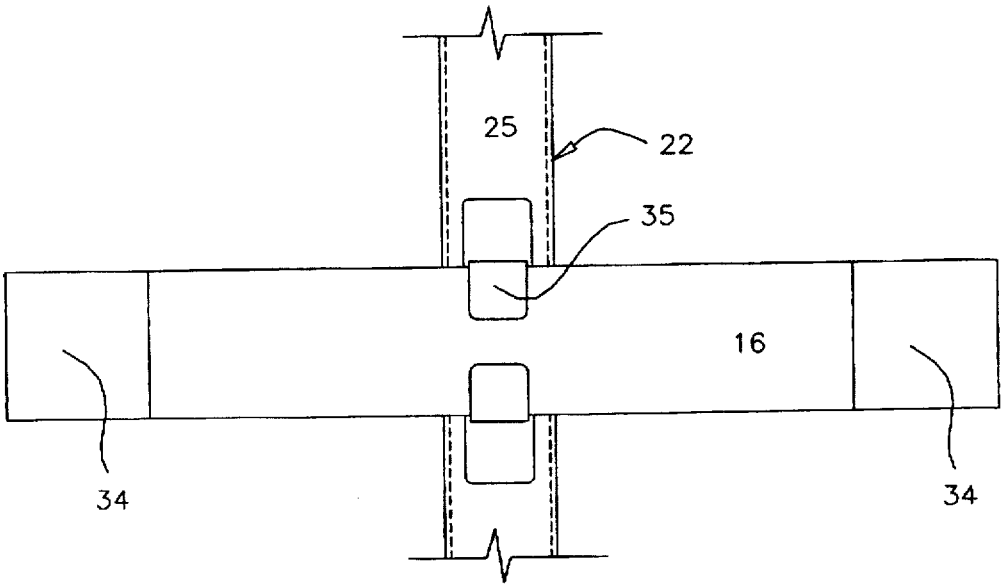
FIG. 3 is a plan view of FIG. 2.
Figure 4:
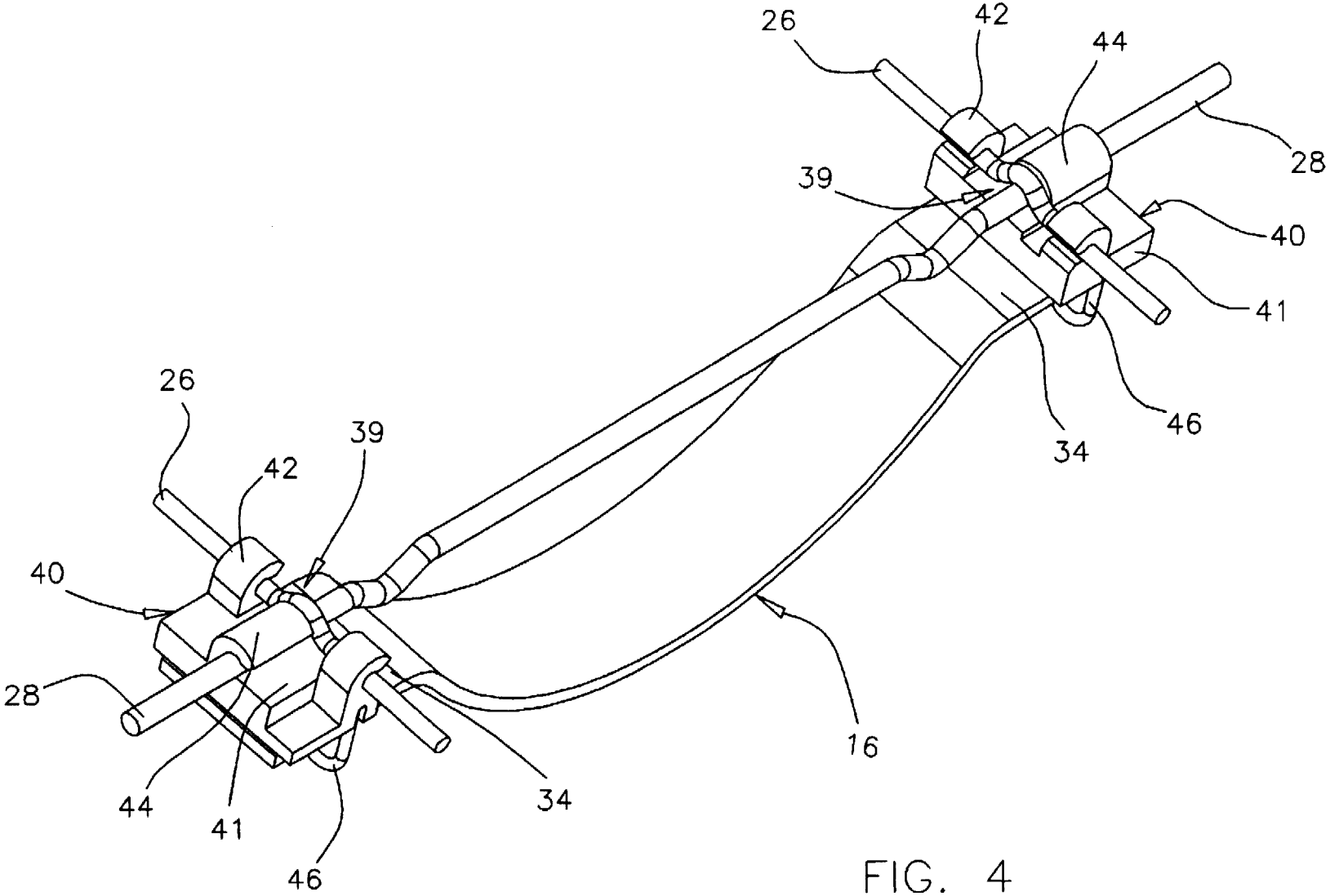
FIG. 4 is an isometric view of a composite material spring module of the present invention and clips which attach the spring module to intersecting wires of a wire grid in accordance with the present invention.

Referring now to FIGS. 2, 3 and 4, the C-shape configuration of the molded spring modules 16 has a central curved section 32 and two generally flat coplanar spring ends 34. The C-shape is one of the preferred shapes of the molded composite material spring modules to obtain the unobvious advantages of a low profile/depth dimension and efficient stress and load distribution. Use of the C-shape spring module allows the total foundation height dimension to be reduced to approximately one-half the height of traditional foundation units, without any compromise or loss of deflection depth, spring rate, compression/decompression life cycles, resilience and support characteristics. The C-shape spring module is designed to deflect at least 100% of its depth dimension, i.e., compress to a completely flattened position without taking a set or breaking. In fact, the C-shape spring module can be deformed beyond the flattened position, i.e., where spring ends 34 travel below the lowest concave point of curved section 32, and still return to its original uncompressed configuration without set or breakage.

The C-shape embodiment of spring modules 16 is a generally elongate configuration, meaning that the length dimension x of the curved section 32 of the spring module is at least twice as long as the depth dimension y. Preferably, the C-shape embodiment of the composite material spring module 16 is configured so that the length dimension x is at least three times, even more preferably four times, the depth dimension y. In the particular C-shape embodiment illustrated, the length dimension x is approximately five times the depth dimension y. Even flatter springs, having length/depth ratios of ten, twenty or more can also be used in accordance with invention.

Regardless of the length/depth ratio of the spring employed in any particular embodiment, the C-shape spring module 16 is configured such that the compressive stress imparted on the grid of the inventive bed system is absorbed by the spring generally in the depth dimension, and generally along the centerline of the module. In addition, the C-shape spring module is configured and made from a material such that it can be compressed to an essentially planar position without reaching its "spring set" condition. Accordingly, even if the inventive bed foundation is subjected to excessive load conditions, the C-shape spring modules will not be deformed or otherwise caused to fail because even at maximum deflection they will not take a spring set.

The C-shape spring module depicted in FIGS. 2 through 5 has a total length dimension of approximately 7.5 inches, a total width dimension of approximately one inch, and a total height/depth dimension (of the central curved section 32 relative to spring ends 34) of approximately 1.25 inches. The internal length dimension x between spring ends 34 is approximately 5.25 inches. A C-shape spring module of these basic dimensions, molded of an advanced composite material such as an epoxy/fiberglass blend or a preferred fiberglass reinforced plastic has a spring rate of approximately 75 pounds per inch, and a controlled spring rate tolerance of +/−5%. Of course, it is understood that each of these dimensions and the resultant spring rate can be easily selectively varied by mold modifications to produce C-shape spring modules of different sizes and stiffness characteristics, as further described below in connection with the spring module manufacturing process.

The spring modules 16 may be produced from a wide variety of composite materials such as fiberglass reinforced plastic, fiberglass in combination with epoxy or vinyl ester, high density plastic such as polyethylene, high density plastic foam, encapsulated steel and steel alloys, or any other material which exhibits the desired spring rates and cycle duration. When made of a fiberglass composite material, the modules are compound molded and/or compression molded into the configuration of the male/female formed mold cavity under heat and pressure. For example, continuous fiberglass strands, approximately 65% to 70% of the product weight, are saturated with a resin system by winding or pultrusion through a bath of epoxy or vinyl ester which is approximately 30% to 35% of the product weight. The material is then loaded into a compression mold and subjected to approximately 200 psi at approximately 300 degrees Farenheit until cured. Flash is removed by conventional methods such as a vibrating pumice bed. The molding material can be selected and blended to produce modules of different spring rates. Also, it is possible that generally linear spring module shapes could be produced solely by a pultrusion process, without the necessity of any molding. Pigments can be used in the molding material to readily identify modules of different spring rates, which greatly aids the assembly process described below. As used herein, the term "composite material" means all such materials described and equivalents, i.e., any material which can be extruded, pultruded and/or molded to have the desired spring rate characteristics.

Certain configurations of the composite material spring modules, as further disclosed below, may be formed by pultrusion and continuous pultrusion of, for example, fiberglass reinforced plastic wherein fiberglass strands (also referred to as fibers) are pulled from a reel through resin impregnating bath followed by application of a surfacing material, and countinuously pulled through a forming and curing die. The continuous strand is then cut to any desired length. Pultrusion is especially well suited for mass production of composite material spring module configurations which are substantially linear. Curvilinear spring module configurations may be pultruded and then compression molded as described. Another significant advantage of formation of spring modules by these processes is the ability to easily alter the spring characteristics of modules simply by altering the number of fibers, and/or the location or orientation of the fibers within the modules. In the preferred embodiment, the fibers are aligned with a length dimension of the module.

As shown in FIG. 3, the central curved section 32 of each C-shape spring module 16 is tangentially attached to longitudinal inner frame member 22 by tabs 35 formed in an upper surface 23 of inner frame member 22 and bent over opposing edges of curved section 32. By arranging the length of the spring modules transverse to the length of inner frame member 22, the spring ends 34 can, under extreme loading conditions, be deflected below the top surface of inner frame member 22. Alternatively, the spring modules could be arranged with the length dimension aligned with the length dimension of the inner frame members to which they are attached, as further described below with reference to FIGS. 8 and 10. If the inner frame member 22 is made of wood or extruded plastic, the C-shape spring module may be simply stapled to the top surface of frame member 22 in a manner in which a channel-type staple straddles the top of the concave surface of the curved section of the module 16.

Figure 5:
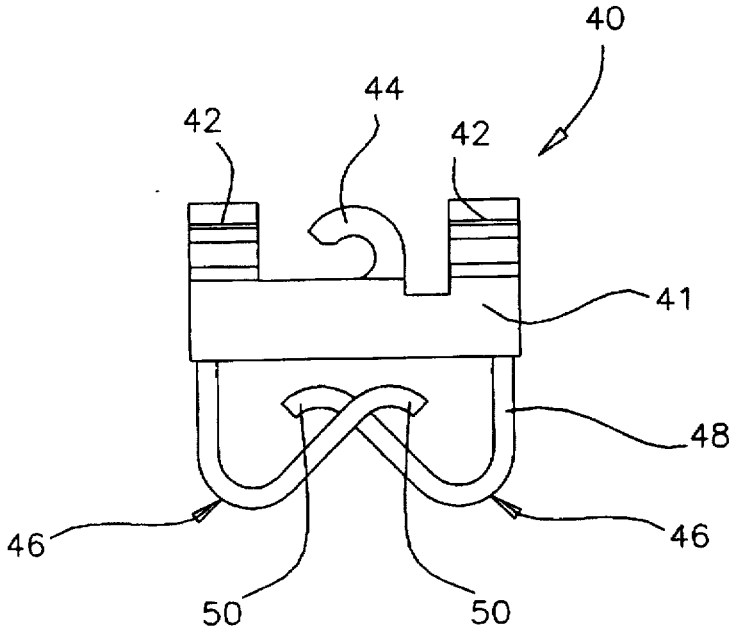
FIG. 5 is an elevational view, partly in section, of the clips of FIG. 4.

As shown in enlarged isolated detail in FIG. 4, spring ends 34 of a spring module 16 are attached to each intersection 39 of longitudinal support elements 26 and transverse cross elements 28 by means of clips 40 which may include a main body 41 from which extend upper longitudinal element engaging fingers 42 and a perpendicularly arranged transverse wire engaging finger (or opposed fingers) 44 for secured attachment to each of the grid elements at intersection 39. Clips 40 further include means for receiving and engaging spring ends 34 which, in this embodiment, is a catcher wire 46, the opposite ends of which are bent around and under main body 41 to form guide sections 48 and engagement end sections 50, as shown in FIG. 5. Engagement end sections 50 may be offset along the length of spring ends 34 to increase the gripping force.

Of course, compression of C-shaped spring 34 in use will cause the spring ends 34 to move outwardly from the spring center. To accommodate this movement, clips 40 are designed to allow sliding movement of spring ends 34 relative to intersections 39 without distorting the matrix, while at the same time keeping the grid securely attached to the spring modules at each intersection. By this structure, each of spring ends 34 is firmly secured to grid 14 while at the same time being free to move in sliding contact relative to each clip 40 and each intersection 39 upon deformation of the spring modules, while remaining securely attached to grid 14.

Figure 6:
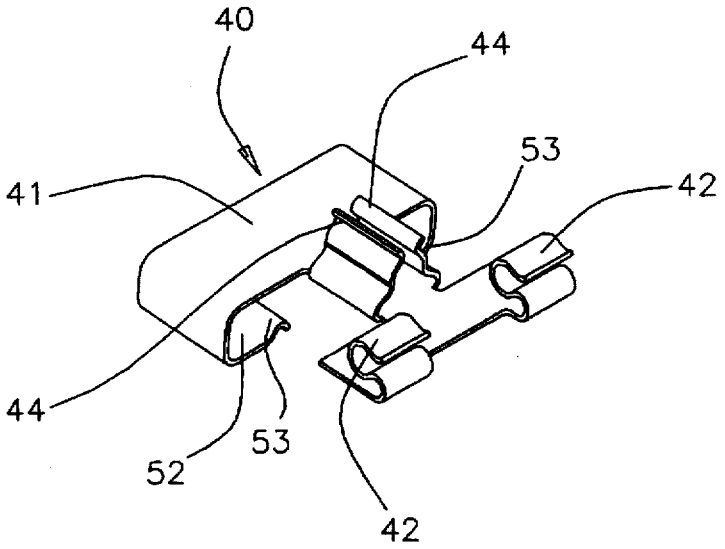
FIG. 6 is an isometric view of an alternate embodiment of a clip for attachment of composite material spring modules to a wire grid in accordance with the present invention.

As shown in FIG. 6, clips 40 may alternatively be constructed from a single piece of spring steel to also have a main body 41, longitudinal element engaging fingers 42, perpendicularly arranged transverse element engaging fingers 44, and a spring end receiving channel 52 formed by inwardly bending the lateral ends of main body 41. Each of the gripping/engaging sections of the steel clip 40 may be formed with chines 53 as is known in the steel spring clip art.

In combination with the reflexive spring action of modules 16 mounted to frame 12 and grid 14 in this manner, support elements 30 of transverse wires 28 provide a dual spring/support action to the foundation. Because support elements 30 may be formed of traditional steel wire, they may have a spring rate different from the modules 16, especially modules formed of composite material. The combination of these two very different spring elements gives the foundation an unique and improved dual spring rate and action. Furthermore, since the inventive design may use a high carbon grid, the grid itself acts as a spring to fully return to the horizontal plane when a load is removed, unlike low carbon welded grids which can permanently bend and deform under a load.

A further significant advantage of the inventive bed foundation is that the overall thickness can be easily selected in the manufacturing process simply by changing the height of the inner frame members which span the frame perimeter. By this invention, it is a comparatively simple matter to alter the height of the inner frame members which support the spring modules to selectively produce a bed foundation of any desired thickness dimension.

Figure 7:
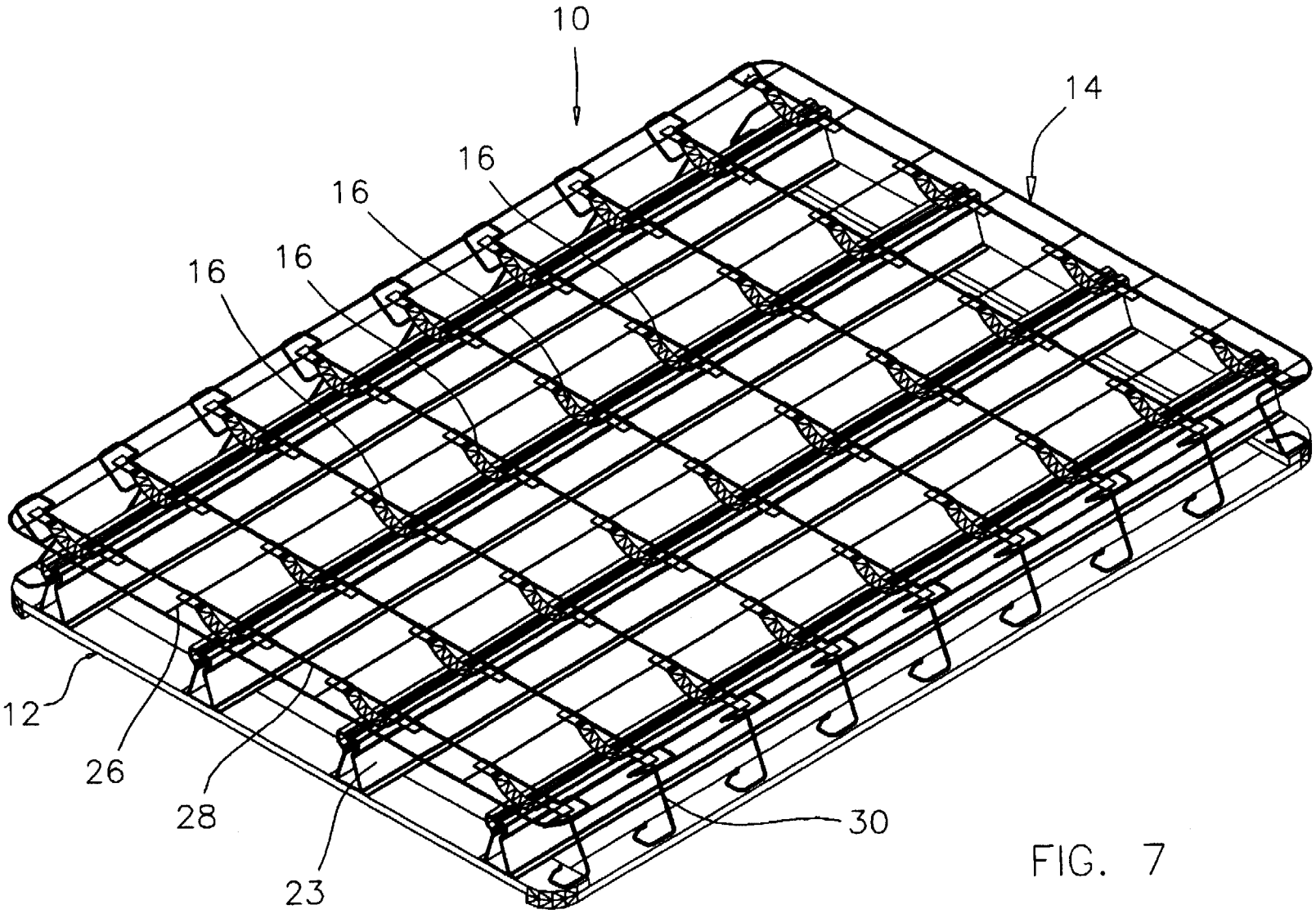
FIG. 7 is a isometric view of an alternate embodiment of a low profile composite material bedding foundation of the present invention.

For example, in the embodiment illustrated in FIG. 7, the composite material spring modules 16 are similarly attached to somewhat elevated inner frame members 23, analogous to frame members 22 of FIG. 1, but having a substantially greater height, thereby increasing the overall height of the foundation. Inner frame members 23 may be formed by extrusion or pultrusion of polypropylene or polyethylene or fiberglass reinforced plastic, or of steel formed by conventional steel shaping methods. The taller cross section of inner frame members 23 also of course increases the structural rigidity of these members and the entire frame 12.

Figure 8:
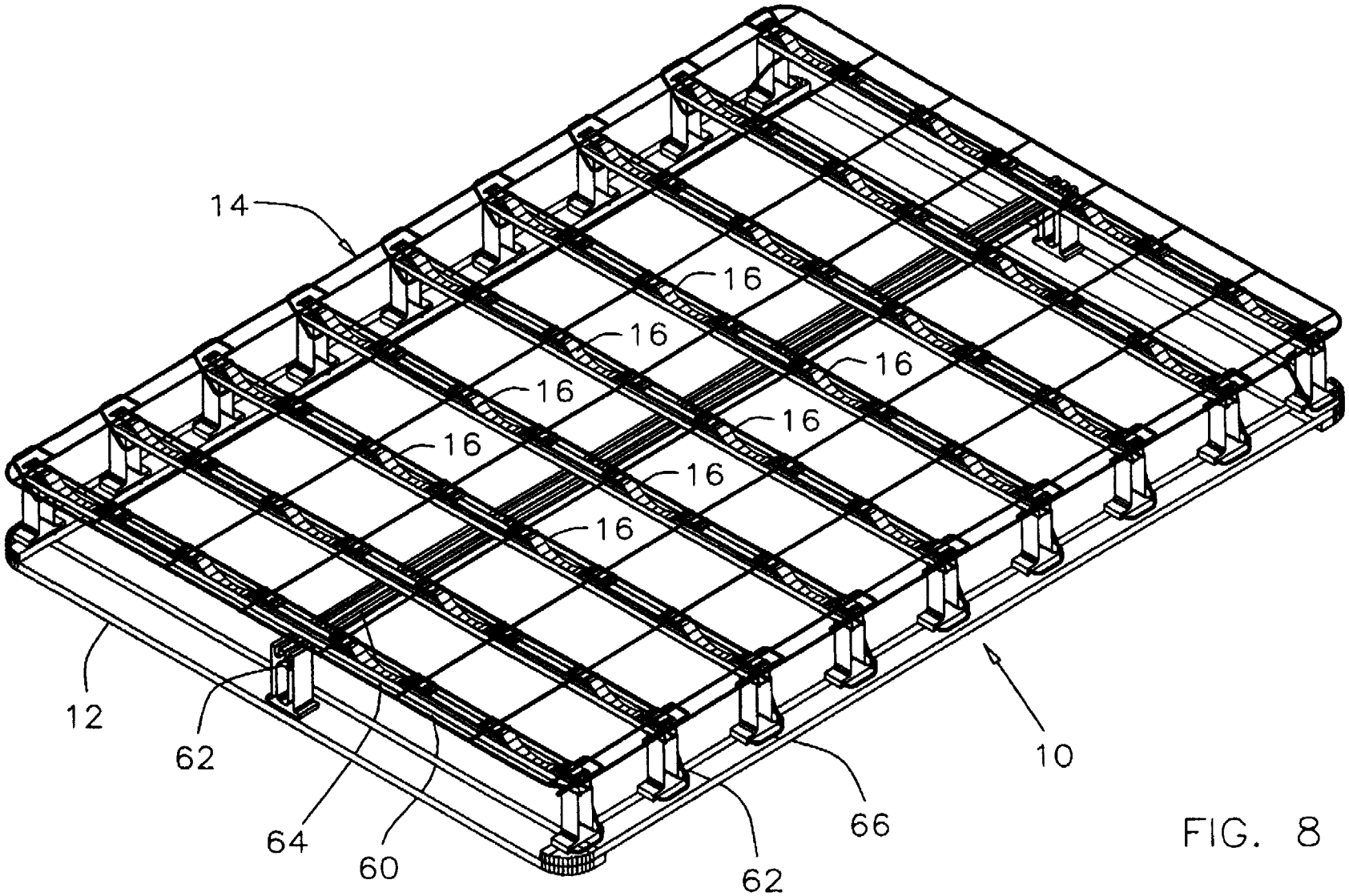
FIG. 8 is an isometric view of alternate embodiment of a composite material bedding foundation of the present invention.
Figure 9:
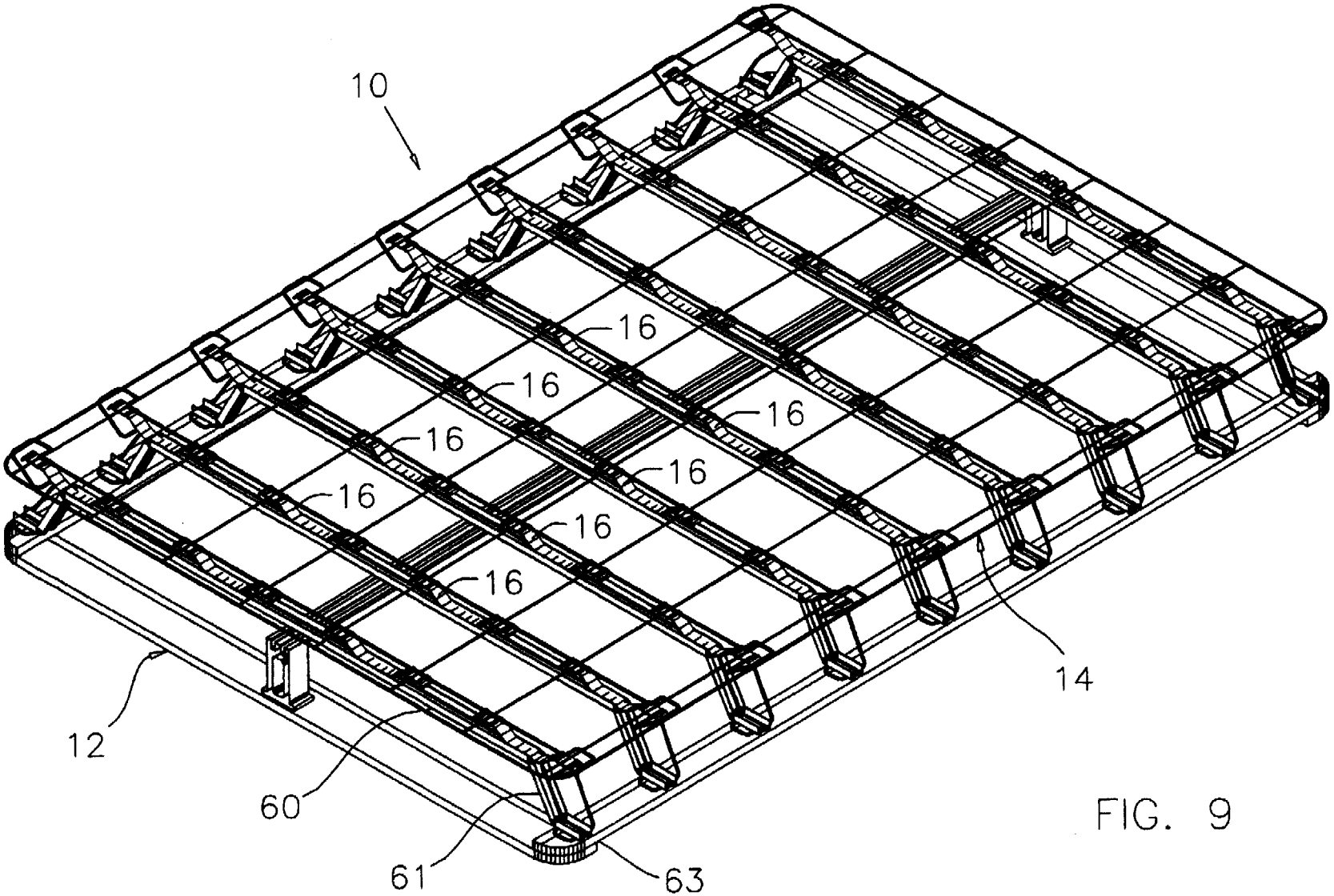
FIG. 9 is an isometric view of alternate embodiment of a composite material bedding foundation of the present invention.

FIGS. 8 and 9 illustrate alternate embodiments of the invention in which low profile spring modules are incorporated into a foundation frame of greater height, to provide foundations having a conventional, i.e., greater, height dimension, but which take advantage of the low profile spring modules. FIG. 8 illustrates a foundation 10 in which inner frame members 60 are arranged transverse to the length of the foundation and supported at distal ends by support posts 62, and by a central longitudinally arranged inner support member 64 also supported by posts 62. Support posts 62 serve to elevate frame members 60, thereby increasing the height of the foundation to conventional dimensions. A generally U-shaped cross-section of frame members 60 is of sufficient width to receive therein the curved section 32 of modules 16 which are thereby aligned with the length of inner frame members 60. Other heightened cross-section inner frame shapes can be used. Tabs may be cut from the vertical walls of frame members 60 to engage the curved section 32 of each module in the correct position, and the spring ends 34 are secured to intersections 39 in a manner similar to that described above. Terminal ends 66 of transverse cross elements 28 are downwardly bent to engage support posts 62. Support posts 62 may also be formed of a composite material, including microcellular urethane or foam, and have some degree of flexibility or plasticity to give the above described dual spring action to the foundation.

As shown in FIG. 9, in lieu of lateral support posts 62, the lateral ends of transverse inner frame members 60 may be downwardly bent to form a strut section 61 and a base 63 for attachment to longitudinal perimeter frame members 18. Strut section 61 gives the foundation a greater overall height.

Figure 10:
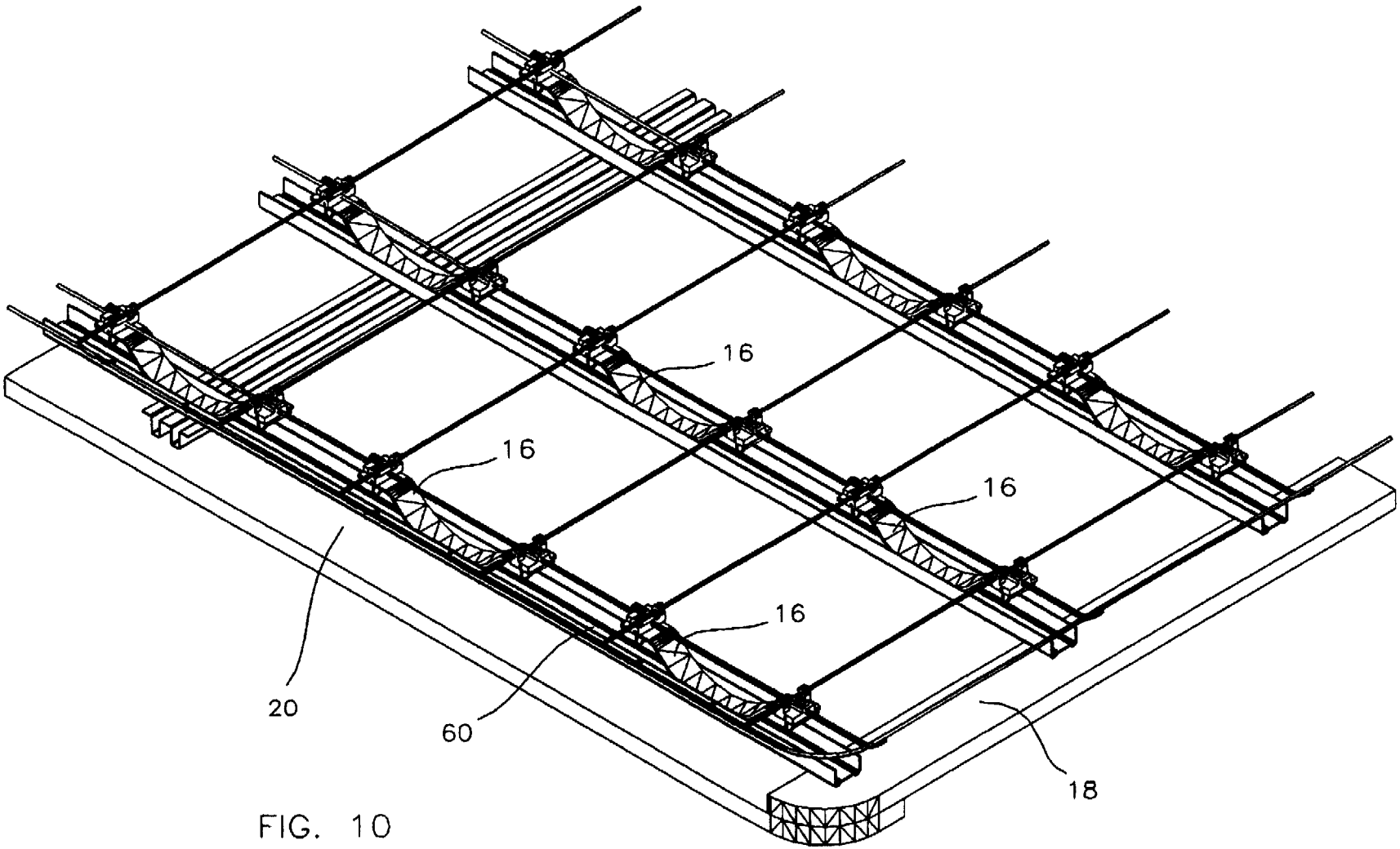
FIG. 10 is an isometric view of alternate embodiment of a low profile composite material bedding foundation of the present invention.

As shown in FIG. 10, the U-shaped frame members 60 may also be mounted directly upon the frame perimeter members 18, 20, without strut sections 61 or elevating support posts 62, in the manner in which frame members 22 are mounted in FIG. 1, for a foundation of minimized height.

Figure 11:
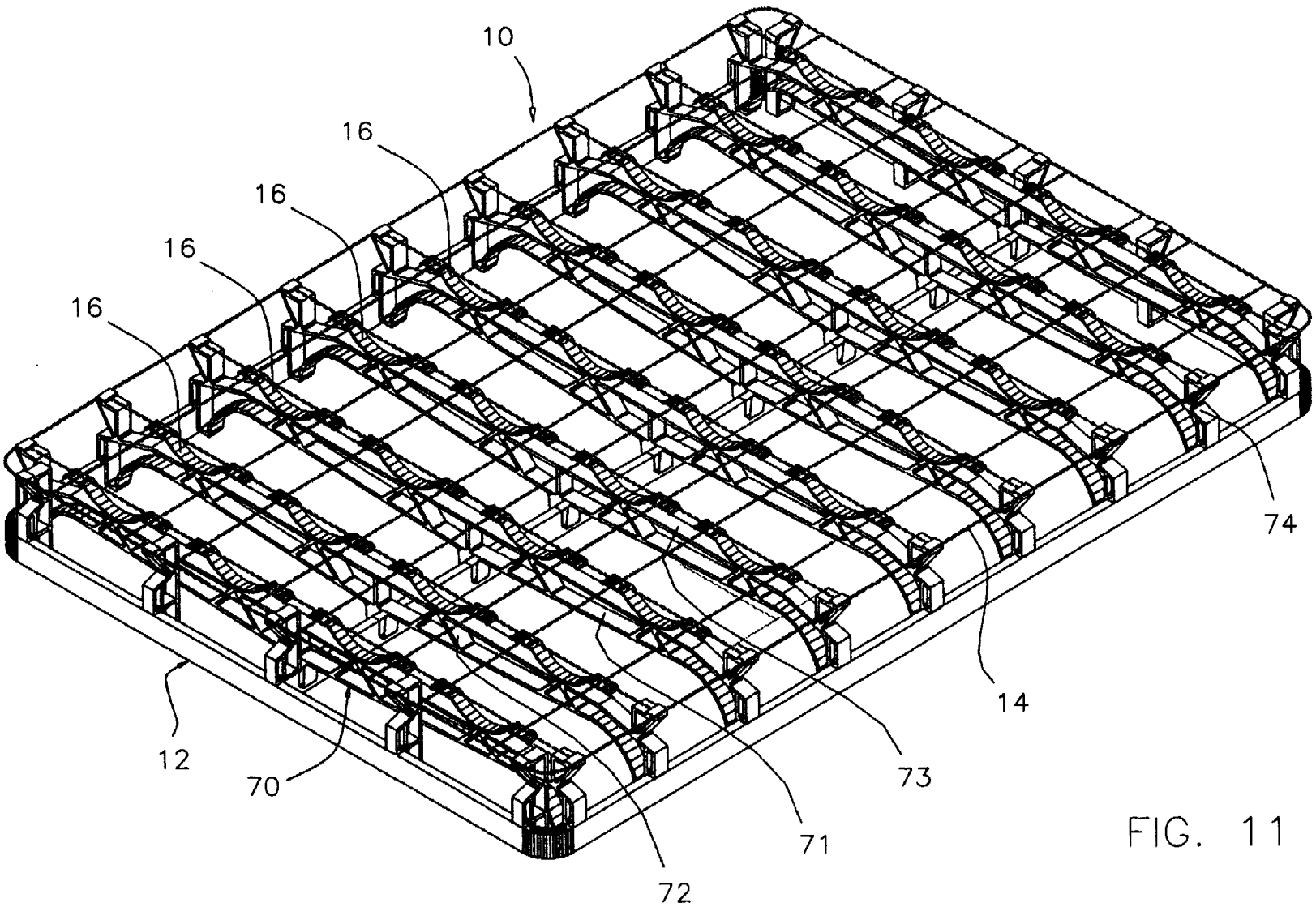
FIG. 11 is an isometric view of alternate embodiment of a low profile composite material bedding foundation of the present invention.

FIG. 11 illustrates another embodiment of the inventive foundation 10 which uses transverse inner frame members 70 formed of composite material such as injection molded structural foam or extruded or pultruded plastic, or compression molded plastic, or blow-molded or rotational cast molded, and/or reaction injection molded polyurethane. Frame members produced in this manner can actually be more rigid than frame members made of cold-rolled steel. As shown, the frame members 70 may be formed as structural trusses, with upper and lower truss spans 71, 72, and reinforcing elements 73 provided under the points of attachment of spring modules 16. Clips can be integrally formed in the top surface of upper truss spans 71 to engage the tangential point of contact of each module. The lateral ends of each frame member 70 may be formed as abutments 74 which fit within and rest upon a frame perimeter 75 which may be constructed of wood or composite material. Abutments 74 may be substituted with, or adapted to rest upon, composite spring modules of a generally vertical configuration to provide the above-described dual spring action without any wire elements. This embodiment has the further advantage of weight reduction from foundations made of wood and steel. In this and other embodiments, frame 12 may be blow molded or formed of extruded or pultruded plastic, such as polyvinyl chloride, polypropylene, polyethylene, or isophthalic polyester with flame retardant additive and fibers when pultruded. The frame could be produced by any of the composite material formation processes applicable to the inner frame members 70.

In accordance with the manufacturing and assembly methods and processes of the invention, the actual assembly of the composite material bedding foundation system is highly flexible and greatly simplified by the relatively small size and simple geometry of the spring modules. For example, to selectively assemble a composite material bedding foundation of the invention the following steps are performed in any logical order. The frame perimeter is first constructed. A determination is made whether the inner module-supporting frame members are to run longitudinally (as in FIG. 1) or transversely (as in FIGS. 8 and 9). A central frame member may be provided to run perpendicular to inner frame members. The number of inner frame members is then selectively determined, limited only by the cross-sectional width of each member, as to how many may be packed within the frame perimeter. The spring modules may be attached to the inner frame members before or after attachment of the inner frame members to the frame perimeter. The number of module attachment points (e.g., in the form of tabs 35) will determine the number of modules which one frame member can support. For example, a single frame member may include as many as forty module attachment points, yet only twenty evenly spaced modules may be attached in the assembly process.

The type of spring modules used may be selected by shape and/or color (indicating spring rate) to be either uniform or any desired combination. For example, modules of a higher spring rate may be placed in the hip and/or back regions of the foundation and lower spring rates near the ends. The grid may have the module-engaging clips first attached to the grid element intersections and then positioned upon the modules for sliding engagement with the spring module ends in the manner described above. Padding and covering is then attached. Each of the assembly steps lends itself to automation given the small size, light weight and simple geometry of the spring modules, and the elimination of dimensional constraints dictated by awkward multiple arm steel wire springs.

As used herein, the term "elongate" in reference to the C-shape spring modules of this invention means that the length of the spring is at least about twice as long as its width. Furthermore, "horizontally arranged", means that a tangent point on the backside or "rear" face of the module, at any point along the approximate central one-third of the curved section is generally horizontal. And "upwardly-arranged" means that the concave or front or face side of the C-shaped faces generally vertically upwardly. Also, when it is indicated herein that a compressive stress acts along the depth dimension of the spring module, this means the compressive stress is applied in such a manner that the module, as a whole, tends to compress in its depth dimension. It does not mean that the stress acts precisely along centerline C of FIG. 2.

Although only a few embodiments have been described above, it should be appreciated that many modifications can be made without departing from the spirit and scope of the invention. For example, it should be appreciated that the C-shape of the C-shape spring modules need not be molded or formed in a continuous curve, but may be formed in a stepped fashion whose shape in the aggregate approximates the central curved section 32 of the C-shape modules 16 illustrated herein. Also, the spring ends 34 of the C-shape spring modules of the invention need not be coplanar or even planar. Nor do these ends need to be slidably mounted with respect to the grid, but may be rigidly secured to the grid at the intersections of the longitudinal and cross elements or at other locations as desired. Also, the C-shape spring modules may be arranged downwardly-facing rather than upwardly-facing as in the particular embodiments illustrated herein.

Figure 12A:
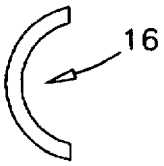
FIGS. 12A–12S are profile views of alternate embodiments of composite material bedding foundation spring modules formed in accordance with the present invention.
Figure 12B:
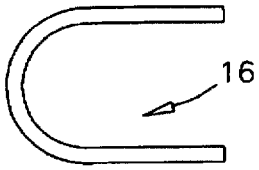
Figure 12C:
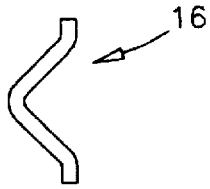
Figure 12D:
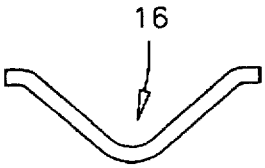
Figure 12E:
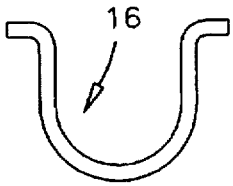
Figure 12F:
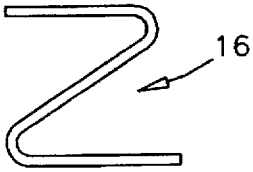
Figure 12G:
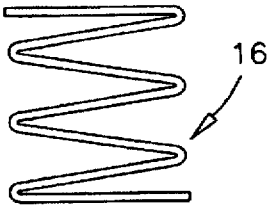
Figure 12H:
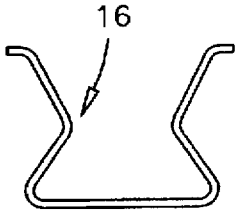
Figure 12I:
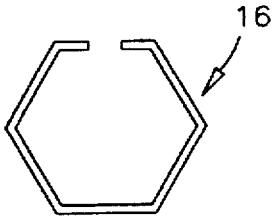
Figure 12J:
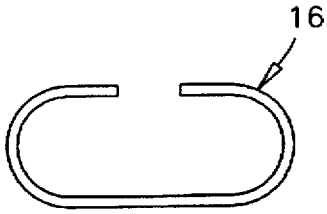
Figure 12K:
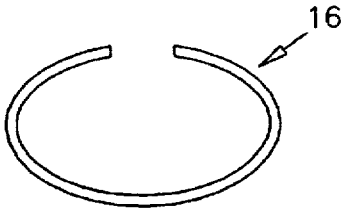
Figure 12L:
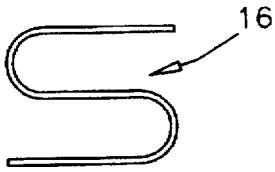
Figure 12M:
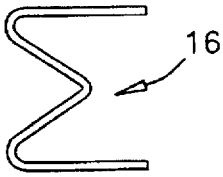
Figure 12N:
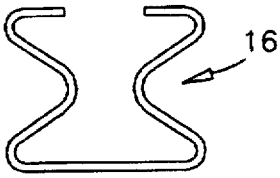
Figure 12O:
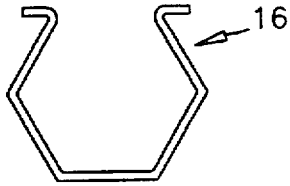
Figure 12P:
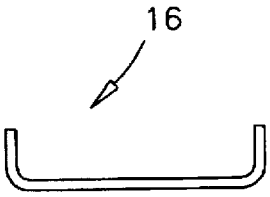
Figure 12Q:
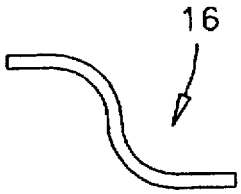
Figure 12R:
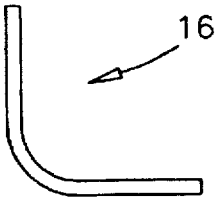
Figure 12S:
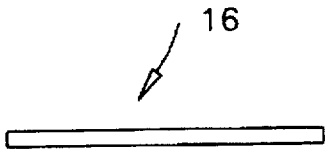

The general C-shape is not the only configuration which may be used in accordance with the invention. The unobvious use of composite material in molding and/or pultrusion processes to produce spring modules for bedding foundations lends itself to a wide variety of spring module configurations, all of which may be similarly selectively molded from blended materials, selectively arranged and attached upon wood or steel or composite inner frame members which may be longitudinal or transverse to the length of the foundation; and secured to the grid. FIGS. 12A through 12S illustrate profiles of representative configurations of bedding foundation spring modules, including substantially linear and substantially curvilinear configurations, which may be molded and attached to frame and grid assemblies in accordance with the invention. Other configurations may be utilized. In particular, the configurations depicted by FIGS. 12H–12K, 12N, 12O and 12S are especially suited for mass production by pultrusion without the necessity of any further molding.

Figure 13:
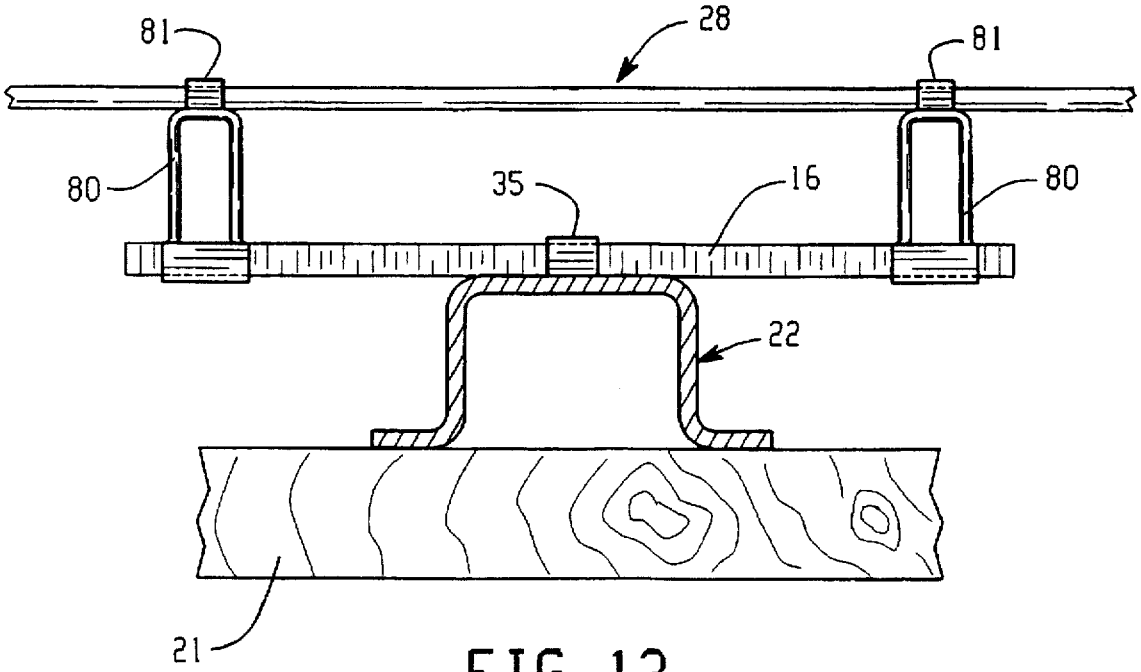
FIG. 13 is an elevational view of an embodiment of attachment of a linear spring module to an inner frame member and a grid.
Figure 14:
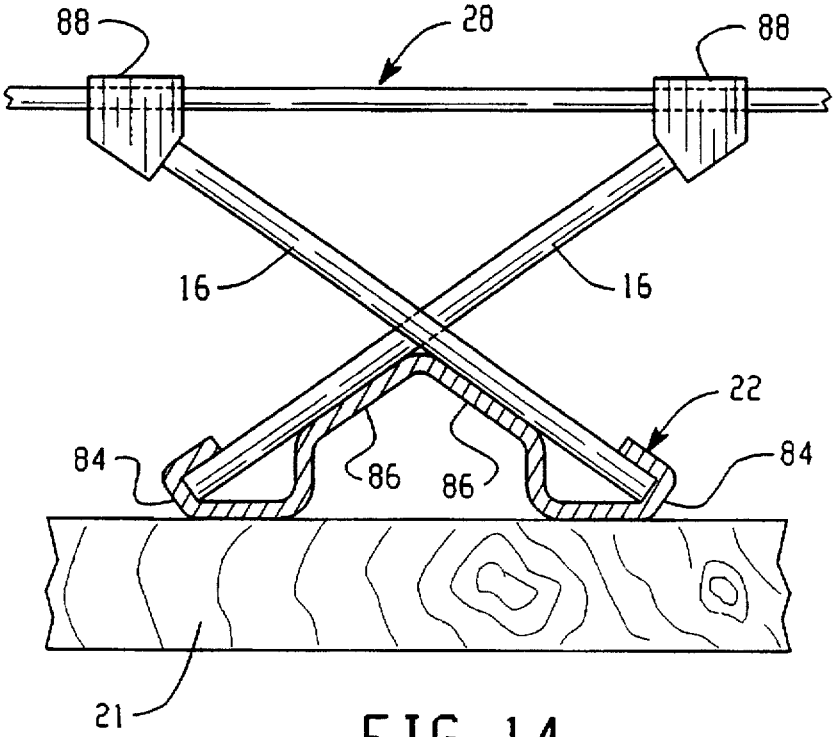
FIG. 14 is an elevational view of an embodiment of an inner frame member in combination with a linear spring module and a grid.

FIGS. 13 and 14 illustrate alternate embodiments by which substantially linear, flat spring modules, such as shown in FIG. 12S, may be mounted to the inner frame members and to grid 14. In FIG. 13, tabs 35 of inner frame member 22 are bent to engage an approximate central section of a linear spring module 16, the lateral ends of which are fitted with lifters 80 which extend upward to attach by a fastener 81 to grid 14. Lifters 80 may be formed as continuous elements which run parallel to inner frame members 22 and span between the lateral ends of a row or column of spring modules. The lifters 80 may also be of composite material molded or pultruded. Fastener 81 may be integrally formed in the top surface of lifter 80 or separately attachable, and contoured to allow for relative motion of the lifters to the grid upon deflection of the spring module.

In FIG. 14, an inner frame member 22 of modified cross-section configuration provides symmetrical opposing footings 84 for angularly receiving and retaining ends of adjacently placed generally linear spring modules 16, portions of which are supported by contact with an angled side wall 86 of inner frame member 22. Upper ends of the spring module are connected to grid 14 by fasteners 88 adapted to slide upon grid 14 upon deflection of the spring module. Any arrangement of linear spring modules on the right or left side of the inner frame member (positive or negative slope) can be made.

Although the invention has been described in detail with respect to certain preferred and alternate embodiments, it will be appreciated to those of skill in the art that certain modifications and variations of the inventive principles disclosed could be made. All such variations and modifications are within the scope and purview of the invention as defined for now by the accompanying claims and all equivalents thereof.

What is claimed is:

1. A low profile composite material bed foundation comprising, a frame including frame perimeter members and inner frame members arranged within said frame perimeter members, a plurality of individual spring modules made of composite material, each spring module separately attached at the point to said inner frame members, and a mattress support structure in the form of a grid attached at two upper points of each of said spring modules, whereby each of said individual spring modules is compressible in response to a force applied to said mattress support structure.

2. The foundation of claim 1, wherein said spring modules have a generally U-shape configuration.

3. The foundation of claim 2 wherein a curved section of each of said U-shape spring modules is attached to said inner frame members and ends of each of said U-shape spring modules are connected to said grid.

4. The foundation of claim 3 wherein ends of each of said U-shape spring modules are connected to said grid by clips which allow said spring ends to slide relative to said grid when a force is applied to said grid.

5. The foundation of claim 2, wherein said U-shape spring modules can be fully compressed to an approximately planar configuration without causing spring set.

6. The foundation of claim 2 wherein said U-shape spring modules are made from fiberglass-reinforced plastic.

7. The foundation of claim 1 wherein a length dimension of said spring modules is aligned with a length dimension of said inner frame members.

8. The foundation of claim 1 wherein a length dimension of said spring modules is perpendicular to a length dimension of said inner frame members.

9. The foundation of claim 1 wherein said frame perimeter members include longitudinal members and transverse members, and wherein said inner frame members are arranged parallel to said transverse members of said members.

10. The foundation of claim 1 wherein said frame perimeter members include longitudinal members and transverse members, and wherein said inner frame members are arranged parallel to said transverse members of said frame.

11. The foundation of claim 1 wherein said inner frame members are connected to said frame perimeter members.

12. The foundation of claim 1 wherein said inner frame members are made of composite material.

13. The foundation of claim 1 wherein said frame perimeter members are made of composite material.

14. The foundation of claim 1 wherein said grid is made of composite material.

15. The spring module of claim 1 in combination with at least one fastener configured for attachment of the spring module to an inner frame member and at least one other fastener configured for attachment of the spring module to the grid of the bed foundation.

16. A bed foundation for use as a support structure for a sleeping mattress, the bed foundation comprising:

a generally rectilinear frame, a plurality of inner frame members attached to said rectilinear frame, a plurality of individual composite material spring modules, each spring module separately attached at a lower point to said inner frame members, and each spring attached at two upper points to a grid supported in a horizontal plane above said spring modules, said grid providing a generally horizontal planar mattress support surface, and said composite spring modules providing deflectable support for said grid.

17. The bed foundation of claim 15 wherein the grid further comprises support elements which are attached directly to the rectilinear frame.

18. The bed foundation of claim 15 further comprising fasteners which attach the spring modules to the grid.

19. The bed foundation of claim 16 wherein said inner frame members further comprise support elements in a generally vertical orientation from ends of the inner frame members to the rectilinear frame.

20. The bed foundation of claim 16 wherein said inner frame members are attached to said rectilinear frame in an orientation generally parallel to a length of said rectilinear frame.

21. The bed foundation of claim 16 wherein said inner frame members are attached to said rectilinear frame in an orientation generally parallel to a width of said rectilinear frame.

22. A low profile mattress foundation support structure, the foundation comprising:

a generally rectangular frame defined by connected length and width perimeter members, a plurality of inner frame members attached to and within said generally rectangular frame, a plurality of individual spring modules made of composite material and attached at one point to said inner frame members and attached at two points to a grid disposed in a plane parallel to a plane in which said rectangular frame and said inner frame members are disposed, whereby said grid is flexibly supported at a distance from said rectangular frame and inner frame members by said plurality of individual spring modules.

23. The foundation of claim 22 wherein said grid further comprises lifter elements which extend generally perpendicular from said grid and attach to said spring modules.

24. The foundation of claim 22 wherein said grid is constructed of composite material.

25. The foundation of claim 22 wherein said generally rectangular frame is constructed of composite material.

26. The foundation of claim 22 wherein each spring module of said plurality of spring modules comprises multiple elements of composite material attached to said grid and to said inner frame members.

27. A low profile bed foundation for use as a deflectable support structure for a sleeping mattress, the foundation comprising:

a rectilinear frame formed by orthogonally connected length and width perimeter members, elongate inner frame members each having an upper and lower area, ends of the inner frame members attached at the lower area to the rectilinear frame and spanning the frame from one perimeter member to an opposite perimeter member, a plurality of spring modules made of composite material, each of said spring modules having a center section attached to an upper area of an inner frame member and an end section on either side of the center section, the end sections of each spring module attached to a grid positioned parallel to the frame, whereby the end sections of each of the spring modules are deflectable in response to forces exerted upon the grid.

28. A composite material spring module for use as a supporting element in a bedding foundation system, said composite material spring module having a substantially linear configuration and being attachable at one point to an inner frame member and a grid of a bedding foundation.

* * * * *